US006357218B1

(12) United States Patent
Ranasinghe et al.

(10) Patent No.: US 6,357,218 B1
(45) Date of Patent: Mar. 19, 2002

(54) STEAM GENERATION SYSTEM AND METHOD FOR GAS TURBINE POWER AUGMENTATION

(75) Inventors: Jatila Ranasinghe, Niskayuna; Charles Michael Jones; Robert Russell Priestley, both of Ballston Lake, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,877

(22) Filed: Jun. 20, 2001

(51) Int. Cl.[7] ..... F02G 3/00
(52) U.S. Cl. ..... 60/39.05; 60/39.07; 60/39.182
(58) Field of Search ..... 60/39.05, 39.5, 60/39.07, 39.182

(56) References Cited

U.S. PATENT DOCUMENTS

| | | | | |
|---|---|---|---|---|
| 2,678,531 A | | 5/1954 | Miller | |
| 3,693,347 A | | 9/1972 | Kydd et al. | |
| 4,393,649 A | | 7/1983 | Cheng | |
| 5,357,741 A | * | 10/1994 | Talabisco | 60/39.05 |
| 5,566,542 A | | 10/1996 | Chen et al. | |
| 5,689,948 A | * | 11/1997 | Frutschi | 60/39.05 |
| 5,727,377 A | | 3/1998 | Fetescu et al. | |
| 6,012,279 A | * | 1/2000 | Hines | 60/39.05 |
| 6,089,011 A | * | 7/2000 | Shouman | 60/39.04 |
| 6,199,363 B1 | * | 3/2001 | Frutschi | 60/39.05 |

* cited by examiner

*Primary Examiner*—Charles G. Freay
*Assistant Examiner*—Ehud Gartenberg
(74) *Attorney, Agent, or Firm*—Nixon & Vanderhye PC

(57) ABSTRACT

A heat rejection system is provided in a recirculating flow line, so that the steam production rate can be controlled from no steam production to maximum steam production for the gas turbine operating condition. For maximum steam production, the heat exchanger of the heat rejection system is bypassed so all the water is directed to the heat recovery unit (HRU). When no steam production is desired, all or a majority of the water is directed to the heat exchanger such that the heat absorbed in the HRU evaporator is equal to the heat rejected by the air cooled heat exchanger. Adjusting the flow split between these two limits allows the steam production rate to vary from no production to the maximum steam production capability corresponding to the gas turbine operating point.

27 Claims, 1 Drawing Sheet

STEAM GENERATION SYSTEM AND METHOD FOR GAS TURBINE POWER AUGMENTATION

BACKGROUND OF THE INVENTION

The present invention relates to gas turbine cycles employing steam injection for power augmentation. More specifically, a system and method are provided that are capable of regulating steam production as required by modern gas turbines with Dry Low NOx (DLN) combustion systems.

Steam injection for gas turbine power augmentation, including steam generation with exhaust heat recovery has been known for many decades. See, e.g., U.S. Pat. No. 2,678,531. The basic concept shown in this patent is widely used even now with non-DLN combustion systems where a once-thru steam generator is used for steam production with exhaust heat. Steam injection at part load gas turbine operation is allowed in non-DLN systems, which make such a once-thru steam generator system a good design for such applications. However, DLN combustion systems impose several additional restrictions on the operating regimes in which steam injection is allowed. These new DLN requirements are that steam injection is permitted only when the gas turbine is at base load and that steam injection is only permitted above a certain ambient temperature, typically above 59° F. The steam generation system should thus have the flexibility to operate with no steam production for all gas turbine operations up to base load, operate at base load with no steam production (when the steam injection is not permitted due to low ambient temperature), and be able to regulate steam production from minimum turndown steam production rate to the maximum steam demand at base load when steam injection is permitted. Meeting these requirements adds considerable capital costs, operating costs and complexity to the exhaust heat recovery steam generation systems known currently. once-thru steam generation system has limited turndown capability (approximately 3:1), and reducing the flow below this minimum limit can result in flow instability, vibration, and tube failure. When the turbine operating regime does not allow for steam injection (in DLN systems), the steam would have to be vented to the atmosphere. Since high quality demineralized water is used in a once-thru steam generator, venting the steam when steam injection is not allowed would result in considerable increase in operating cost, and would be an unattractive option to end users of such power plants.

There are additional potential design options that may be considered. For example, completely turning-off the water flow/steam production in the once-thru boiler, when there is no requirement for steam injection, has been considered. The design of a once-thru steam generator for dry operation (i.e., with no flow inside the tubes, while hot gases flow outside) at maximum gas turbine exhaust temperatures (~1200° F.) requires the use of high cost alloy materials. Also, the introduction of cold water into the evaporator tubes of a dry hot boiler (when there is steam demand following dry operation) results in thermal shock which would result in considerable reduction in the life of the boiler. The reliability and cost impact make such a design unattractive.

One might also consider condensing the steam and re-use of the water when there is no demand for steam. However, such steam condensing heat exchangers would have to be manufactured with alloy material compatible with the high steam temperature resulting in high capital cost for the addition of such equipment.

The addition of a steam turbine to expand unused steam has been disclosed in U.S. Pat. No. 5,727,377. Condensing the expanded low temperature steam and re-use of the water is also discussed in this patent. Additional equipment required in such a system, additional capital cost, and added complexity in control make such a system unattractive for peaking power application.

Diverting the hot exhaust gas to a parallel duct installed with the heat recovery section has been disclosed in the U.S. Pat. No. 3,693,347, to control the steam production rate in a once-thru boiler. This would require a diverter damper. Modern gas turbines have very high exhaust gas flow rates and such diverter dampers become extremely large, unreliable, and costly. Also, large diverter dampers always tend to have leakage and such leakage could result in the stagnant gas volume in the heat transfer section approaching the exhaust gas temperature over long term operation. Hence, the heat transfer section material would have to be selected similar to the dry operation described above, and there is also the potential for thermal shock of the hot tubes when water is introduced.

The use of drum type boilers for exhaust heat recovery and varying the drum pressure to regulate the steam production rate has also been disclosed by others (U.S. Pat. Nos. 5,566,542 and 4,393,649). While steam production rate can be regulated by varying the drum pressure, high exhaust temperatures of modern gas turbines would result in a very limited turndown capability from such a control method.

Thus, the DLN restrictions have resulted in the need to develop an exhaust heat recovery steam generation system with improved steam production regulation capability, for the economical implementation of steam injection in modern gas turbine power plants with DLN combustion systems.

SUMMARY OF THE INVENTION

The invention is embodied in a steam generation system and method that provides an economical solution for implementation of exhaust heat recovery steam generation for injection to modern gas turbines with DLN combustion systems. More specifically, the invention is embodied in a unique and improved method of controlling the steam production rate that has the capability to control the steam production rates from no steam generation to maximum rated steam production at base load gas turbine operation and no steam production at all, part load gas turbine operation. The invention provides this flexibility while being able to use conventional low cost material for heat recovery sections and a heat rejection system.

Thus, the invention is embodied in a gas turbine cycle that comprises a gas turbine system including a compressor for compressing air, a combustion system for receiving compressed air from the compressor and a turbine for converting the energy of the combustion mixture that leaves the combustion system into work; a heat recovery system for receiving exhaust gas from the gas turbine; a first flow path for at least one of water and steam at elevated pressure including a first heat exchange flow path disposed in heat exchange relation to the exhaust gas flowing through the heat recovery system, thereby to produce an at least partly evaporated fluid stream; a second flow path for at least one of water and steam defining a power augmenting flow path operatively coupled to the first flow path for receiving flow therefrom, the second flow path including a second heat exchange flow path disposed in heat exchange relation to the exhaust gas flowing through the heat recovery system, thereby to produce superheated steam, the second flow path being operatively coupled to at least one of the gas turbine compressor discharge and the combustion system of the gas turbine for increasing the mass flow of fluid thereinto; a third flow path for at least one of water and steam defining a recirculating flow path operatively coupled to the first flow path for receiving fluid therefrom and for recirculating the fluid to the first heat exchange flow path; and a heat rejector system for selectively cooling fluid flowing through the third flow path thereby to reduce a temperature of the fluid upstream of the first heat exchange flow path.

In an exemplary embodiment, a separator, more specifically a dearator, is provided for separating the at least partly evaporated fluid stream into saturated steam for flow through the second flow path and water for recirculation through the third flow path.

In one embodiment, the heat rejection system comprises parallel flow paths defined by a split of the third flow path, and a heat exchanger is disposed along one of the parallel flow paths for reducing the temperature of the fluid flowing therethrough. A valve unit may be disposed at an upstream juncture of the parallel flow paths for controlling flow of fluid into each of the parallel flow paths.

The second heat exchange flow path is advantageously disposed downstream, in a direction of exhaust gas flow, from the first heat exchange flow path.

The invention is also embodied in a method for augmenting the power produced by a gas turbine system of the type having a compressor for compressing air to produce compressed air, a combustor for heating said compressed air and producing hot gases, and a turbine for receiving said hot gases and converting the energy thereof to work for driving said compressor, for supplying a load, and for producing hot exhaust gases, the method comprising flowing a fluid through a first flow path including a first heat exchange flow path disposed in heat exchange relation to said exhaust gas, thereby to produce an at least partly evaporated fluid stream; selectively flowing a part of said fluid stream through a second flow path including a second heat exchange flow path disposed in heat exchange relation to said exhaust gas, thereby to produce superheated steam for injection to at least one of the gas turbine compressor discharge and the combustion system of the gas turbine for increasing the mass flow of fluid thereinto; selectively flowing a remainder of said fluid stream through a third flow path for recirculating said fluid to said first heat exchange flow path; and selectively cooling fluid flowing through said third flow path thereby to reduce a temperature of said fluid upstream of said first heat exchange flow path.

DETAILED DESCRIPTION

Figure 1:
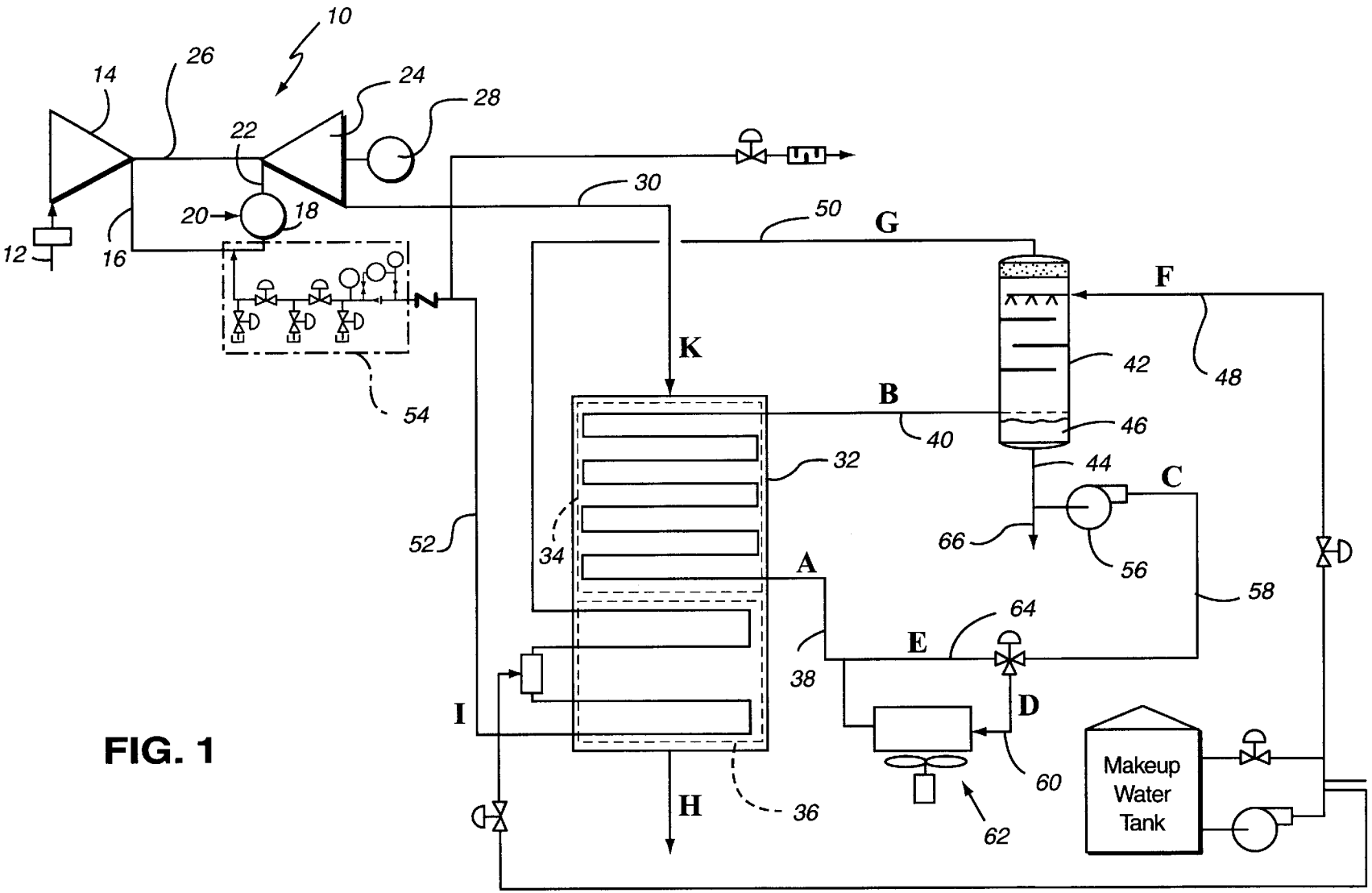
FIG. 1 is a schematic illustration of an exhaust heat recovery steam generation system embodying the invention.

An exhaust heat recovery steam generation system embodying the invention is schematically illustrated in FIG. 1. A generally conventional simple cycle gas turbine 10 is shown in the embodiment of FIG. 1. Thus, air 12 enters the axial flow compressor 14 and the thus produced compressed air 16 enters the combustion system 18 where fuel 20 is injected and combustion occurs. The combustion mixture 22 leaves the combustion system 18 and enters the turbine 24. In the turbine section, energy of the hot gases is converted into work. This conversion takes place in two steps, the hot gases are expanded and a portion of the thermal energy is converted into kinetic energy in the nozzle section of the turbine. Then, in the bucket section of the turbine, a portion of the kinetic energy is transferred to the rotating buckets and converted to work, e.g. rotation of shaft 26. A portion of the work developed by the turbine is used to drive the compressor 14, whereas the remainder is available for, e.g., an electrical generator or mechanical load 28. Hot exhaust gas 30 leaves the turbine and flows to a heat recovery unit 32. The heat recovery unit may take the form of any one of a variety of known heat exchange systems including, for example, an exhaust heat boiler or an otherwise conventional heat recovery steam generator (HRSG). The heat from the gas turbine's exhaust gas 30 enters a pressurized working fluid supply in the heat recovery unit.

The illustrated system shows a heat recovery unit 32 comprised of an evaporator section 34 and a super heater section 36. In the illustrated embodiment, the superheater section is located downstream of the evaporator section with respect to a direction of exhaust gas flow therethrough, as described in greater detail below.

Water 38 enters the evaporator, and is partially vaporized in the evaporator, typically to a vapor fraction of 10–20%. The evaporator outlet stream 40 enters at the bottom of a dearator 42, where vapor and liquid of the stream are separated. The liquid 46 is collected at the bottom of the vessel, whereas the vapor flows upwards in the vessel. Makeup water 48 enters the dearator at the top of the vessel and flows down countercurrent to the upward flowing steam. Trays or packing are provided in the dearator to ensure good contact between the makeup water and the steam. The makeup water is heated to saturation and dearated by the upward flowing steam, part of which condenses in this process.

The saturated steam 50, and the air removed from the makeup water, flows out of the dearator 42 and enters the heater recovery unit superheater 36. The superheated steam 52 is the injected via gas turbine system valving 54 to the combustor 18 for gas turbine power augmentation. The dearated water 44 leaving the dearator 42 is pumped by pump 56 to a higher pressure sufficient to overcome the resistance in the recirculation circuit. A heat rejection system 62 is provided between the dearator drum water outlet 44 and the evaporator inlet 38 as a unique feature of this invention, to allow the steam production rate to be controlled from no steam production to maximum steam production for the gas turbine operating condition.

In the illustrated embodiment, the recirculation pump 56 outlet stream 58 is split into two streams, one stream 60 going through a heat rejection system 62 which may be an air cooled heat exchanger, as shown, or a water cooled heat exchanger if auxiliary cooling water is available in the plant. The other stream 64 bypasses the heat rejection system. As illustrated, there would be some blowdown 66 of the dearator bottoms water for drum water purity control.

For maximum steam production, the air cooled heat exchanger is completely bypassed with all the water 58 directed to stream 38. When no steam production is desired, all or a majority of the water is directed to stream 60 such that the heat absorbed in the evaporator 34 of the heat recovery unit (HRU) is equal to the heat rejected by the heat rejection system (air cooled heat exchanger) 62. Adjusting the flow split between these two limits will allow the steam production rate to vary from no production to the maximum steam production capability corresponding to the gas turbine operating point. It is to be noted that since the heat absorbed by the HRU may be difficult to calculate due to the two phase stream 40, adjusting the flow split to maintain a target drum pressure will result in achieving the same objective. The heat rejection system 62 in the illustrated embodiment is placed in a single phase liquid stream 58 at low temperature with adequate pressure drop available to minimize the cooler size, and, hence, is more economical and less complex to control compared to a steam condensing system.

The recirculation system flow 58 is advantageously kept constant for all gas turbine operating conditions, thus ensuring that the evaporator is not operated dry at any time. It is to be noted that constant recirculation flow is preferred to simplify the system control, but is not essential. Operation of the evaporator 34 wet at all times together with the use of demineralized and dearated water 58 allows the selection of low cost conventional heat recovery steam generator material for the evaporator 34.

The superheater 36 will operate dry when there is no steam flow, but superheater designs for dry operation have been provided in the past, such as dry reheaters in combined cycle power plant HRSG's. The superheater metal temperature will reduce gradually when steam flow increases after dry operation, unlike a hot dry tube exposed to water where the metal will quench to the water temperature rapidly. Also, by placing the superheater section downstream of the evaporator section as in the illustrated embodiment, the superheater is exposed to gas which has already been cooled by the evaporator, which is operating at all times.

By way of example, the following Table 1 illustrates typical steam temperature, flow and pressure data from the steam generation system illustrated in FIG. 1, with a DLN combustion system and steam injection for power augmentation. The first column of the Table designates the location of the provided data as designated in FIG. 1; the second column shows the conditions when maximum steam is being generated; and the third column shows the conditions in the case of system operation with no steam generation. In these examples, the single phase liquid cooling air cooler's size was estimated as 2 bays with each bay 13.5 feet wide and 44 feet tube length, constructed of four rows of carbon steel tubes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

TABLE 1

| LOCATION | MAXIMUM STEAM | NO STEAM |
|---|---|---|
| A | 1,120,000 lb/hr<br>445° F.<br>450 psia | 1,120,000 lb/hr<br>326° F. |
| B | 1,120,000 lb/hr<br>445° F.<br>400 psia<br>0.15 Vap. Mass Frac | 1,120,000 lb/hr<br>445° F.<br>400 psia<br>Saturated Liquid |
| C | 1,120,000 lb/hr<br>445° F.<br>500 psia | 1,120,000 lb/hr<br>445° F. |
| D | 0 lb/hr | 1,120,000 lb/hr<br>445° F |
| E | 1,120,000 lb/hr<br>445° F.<br>450 psia | 0 lb/hr |
| F | 111,900 lb/hr<br>60° F. | 0 lb/hr |

TABLE 1-continued

| LOCATION | MAXIMUM STEAM | NO STEAM |
|---|---|---|
| G | 111,900 lb/hr<br>445° F.<br>400 psia<br>Sat Steam | 0 lb/hr |
| H | 993° F. | 999° F. |
| I | 111,900 lb/hr<br>700° F.<br>390 psia | 0 lb/hr |

What is claimed is:

1. A gas turbine cycle comprising:

a gas turbine system including a compressor for compressing air, a combustion system for receiving compressed air from the compressor and a turbine for converting the energy of the combustion mixture that leaves the combustion system into work;

a heat recovery system for receiving exhaust gas from the gas turbine;

a first flow path for at least one of water and steam at elevated pressure including a first heat exchange flow path disposed in heat exchange relation to said exhaust gas flowing through said heat recovery system, thereby to produce an at least partly evaporated fluid stream;

a second flow path for at least one of water and steam defining a power augmenting flow path operatively coupled to said first flow path for receiving flow therefrom, said second flow path including a second heat exchange flow path disposed in heat exchange relation to said exhaust gas flowing through said heat recovery system, thereby to produce superheated steam, said second flow path being operatively coupled to at least one of the gas turbine compressor discharge and the combustion system of the gas turbine for increasing the mass flow of fluid thereinto;

a third flow path for water defining a recirculating flow path operatively coupled to said first flow path for receiving fluid therefrom and for recirculating said fluid to said first heat exchange flow path; and a heat rejector system for selectively cooling fluid flowing through said third flow path thereby to reduce a temperature of said fluid upstream of said first heat exchange flow path.

2. A cycle as in claim 1, wherein said heat rejection system comprises parallel flow paths defined by a split of said third flow path, and a heat exchanger is disposed along one of said parallel flow paths for reducing a temperature of the fluid flowing therethrough.

3. A cycle as in claim 2, further comprising a valve unit disposed at an upstream juncture of said parallel flow paths for controlling a flow of said fluid into each of said parallel flow paths.

4. A cycle as in claim 2, wherein said heat exchanger is an air cooled heat exchanger.

5. A cycle as in claim 1, wherein said second heat exchange flow path is disposed downstream, in a direction of exhaust gas flow, from said first heat exchange flow path.

6. A cycle as in claim 1, further comprising a separator for separating said at least partly evaporated fluid stream into saturated steam for flow through said second flow path and water for recirculation through said third flow path.

7. A cycle as in claim 6, further comprising a flow line for flowing makeup water from a makeup water source to said separator.

8. A cycle as in claim 7, wherein said flow line adds makeup water to a vertically upper portion of said separator for flowing countercurrent to steam therein.

9. A system for augmenting power produced by a gas turbine system of the type including a compressor for compressing air to produce compressed air, a combustor for heating said compressed air and producing hot gases, and a turbine for receiving said hot gases and converting the energy thereof to work for driving said compressor, for supplying a load, and for producing hot exhaust gases, said system comprising:

a working fluid supply;

a heat recovery unit for receiving hot exhaust gases from said gas turbine;

a first flow path operatively coupled to said heat recovery unit for flowing said working fluid to produce at least partially evaporated working fluid;

a second flow path for flowing said at least partially evaporating working fluid;

a third flow path operatively coupled to said heat recovery unit for selectively flowing a portion of said at least partially evaporating working fluid to produce superheated working fluid;

a fourth flow path for flowing said superheated working fluid to said combustor for injection for augmenting power produced by said gas turbine system;

a fifth flow path for selectively flowing a water remainder of said at least partially evaporating working fluid to said heat exchanger; and a heat rejection system for reducing a temperature of the working fluid returning to said heat recovery unit via said fifth flow path.

10. A system as in claim 9, wherein said heat rejection system comprises parallel flow paths defined by a split of said fifth flow path, and a heat exchanger is disposed along one of said flow paths for reducing a temperature of the working fluid flowing therethrough.

11. A system as in claim 10, further comprising a valve unit disposed at an upstream juncture of said parallel flow paths for controlling a flow of said working fluid into each of said parallel flow paths.

12. A system as in claim 10, wherein said heat exchanger is an air cooled heat exchanger.

13. A system as in claim 9, further comprising a flow separator at a junction of said second, third and fifth flow paths for separating vapor and liquid of the at least partly evaporated working fluid, said vapor flowing therefrom along said third flow path and said liquid flowing therefrom along said fifth flow path.

14. A system as in claim 13, wherein said flow separator is a dearator.

15. A system as in claim 9, wherein said first flow path is upstream of said third flow path with respect to a flow of exhaust gas through said heat recovery unit.

16. A gas turbine system in combination with a system for augmenting power produced by said gas turbine system, comprising:

a compressor for compressing air to produce compressed air;

a combustor for heating said compressed air and producing hot gases;

a gas turbine for receiving said hot gases and converting the energy thereof to work for driving said compressor, for supplying a load, and for producing hot exhaust gases;

a working fluid supply;

a heat recovery unit for receiving hot exhaust gases from said gas turbine;

a first flow path operatively coupled to sail heat recovery unit for flowing said working fluid to produce at least partially evaporated working fluid;

a second flow path for flowing said at least partially evaporating working fluid;

a third flow path operatively coupled to said heat recovery unit for selectively flowing a portion of said at least partially evaporating working fluid to produce superheated working fluid;

a fourth flow path for flowing said superheated working fluid to said combustor for injection for augmenting power produced by said gas turbine system;

a fifth flow path for selectively flowing a water remainder of said at least partially evaporating working fluid to said heat exchanger; and a heat rejection system for reducing a temperature of the working fluid returning to said heat recovery unit via said fifth flow path.

17. A system as in claim 16, wherein said heat rejection system comprises parallel flow paths defined by a split of said fifth flow path, and a heat exchanger is disposed along one of said flow paths for reducing a temperature of the working fluid flowing therethrough.

18. A system as in claim 17, further comprising a valve unit disposed at an upstream juncture of said parallel flow paths for controlling a flow of said working fluid into each of said parallel flow paths.

19. A system as in claim 17, wherein said heat exchanger is an air cooled heat exchanger.

20. A system as in claim 16, further comprising a flow separator at a junction of said second, third and fifth flow paths for separating vapor and liquid of the at least partly evaporated working fluid, said vapor flowing therefrom along said third flow path and said liquid flowing therefrom along said fifth flow path.

21. A system as in claim 20, wherein said flow separator is a dearator.

22. A system as in claim 16, wherein said first flow path is upstream of said third flow path with respect to a flow of exhaust gas through said heat recovery unit.

23. A method for augmenting the power produced by a gas turbine system of the type having a compressor for compressing air to produce compressed air, a combustor for heating said compressed air and producing hot gases, and a turbine for receiving said hot gases and converting the energy thereof to work for driving said compressor, for supplying a load, and for producing hot exhaust gases, the method comprising:

flowing a fluid through a first flow path including a first heat exchange flow path disposed in heat exchange relation to said exhaust gas, thereby to produce an at least partly evaporated fluid stream;

selectively flowing a part of said fluid stream through a second flow path including a second heat exchange flow path disposed in heat exchange relation to said exhaust gas, thereby to produce superheated steam for injection to at least one of the gas turbine compressor discharge and the combustion system of the gas turbine for increasing the mass flow of fluid thereinto;

selectively flowing a water remainder of said fluid stream through a third flow path for recirculating said fluid to said first heat exchange flow path; and selectively cooling fluid flowing through said third flow path thereby to reduce a temperature of said fluid upstream of said first heat exchange flow path.

24. A method as in claim 23, wherein said step of selectively cooling fluid comprises flowing at least a portion of said fluid flowing through said third flow path through a heat exchanger to reducing a temperature of said portion of the fluid.

25. A method as in claim 23, wherein said second heat exchange flow path is disposed downstream, in a direction of exhaust gas flow, from said first heat exchange flow path.

26. A method as in claim 23, further comprising separating said at least partly evaporated fluid stream into saturated steam for flow through said second flow path and water for recirculation through said third flow path.

27. A method as in claim 23, further comprising selectively adding makeup water at least one of said first, second and third flow paths.

* * * * *